United States Patent [19]

Schmidt

[11] 4,402,466

[45] Sep. 6, 1983

[54] BOWL CUTTER AND MIXER FOR FOODSTUFFS

[75] Inventor: Walter Schmidt, Gossau, Switzerland

[73] Assignee: C. Hoegger & Cie. AG, Gossau, Switzerland

[21] Appl. No.: 264,169

[22] Filed: May 15, 1981

[30] Foreign Application Priority Data

May 22, 1980 [CH] Switzerland ..... 4022/80

[51] Int. Cl.[3] ..... B02C 18/14; B02C 18/24

[52] U.S. Cl. ..... 241/199.7; 241/282.1; 241/DIG. 14

[58] Field of Search ..... 241/199.1, 199.5, 199.6, 241/199.7, 282.1, 282.2, DIG. 14

[56] References Cited

U.S. PATENT DOCUMENTS 3,764,081 10/1973 Seydelmann ..... 241/282.1 X
3,879,000 4/1975 Muller et al. ..... 241/282.1
4,000,861 1/1977 Grebe et al. ..... 241/199.7 X

FOREIGN PATENT DOCUMENTS 673498 6/1952 United Kingdom ..... 241/199.1

*Primary Examiner*—Howard N. Goldberg
*Attorney, Agent, or Firm*—Sughrue, Mion, Zinn, Macpeak and Seas

[57] ABSTRACT

A cutter and mixer apparatus for foodstuffs has a bowl 4 rotatably mounted in a housing. Rotary knives 10 are attached to a shaft 16 and extend into the bowl. The bowl is covered by two hoods 31, 32 which are hinged approximately in the middle above the bowl and can be swung up and open opposite one another. Below the bowl a primary plate 3 is situated on whose one end a vertical sidewall 20 is welded. An angled yoke 24 spans the bowl and is attached at one end to the sidewall and at the other end to the opposite side of the primary plate. The plate, sidewall and yoke form the support frame for the apparatus on which all important functional parts are attached. The closed construction provides for an efficient power transfer and a high level of stability.

11 Claims, 4 Drawing Figures

BOWL CUTTER AND MIXER FOR FOODSTUFFS

BACKGROUND OF THE INVENTION

This invention relates to an apparatus for cutting and mixing foodstuffs within a rotatable bowl mounted in a housing. Rotating knives are attached to a horizontal shaft and extend into the bowl, and the housing is covered by two hoods hinged in the middle above the bowl which fold open upwardly and away from each other.

German Offenlegungsschrift No. 2,155,647 discloses a bowl cutter apparatus for cutting and mixing foodstuffs, wherein the housing is made by a casting process. The upper part of the housing serves as a knife hood. It is attached by a rear hinge to the edge of the lower part of the housing and can be swung upwardly. In addition to the upwardly swinging knife hood, this cutter apparatus has a safety lid which covers the front area of the bowl. This safety lid is attached to an arm which reaches over the knife hood and is mounted on the rear, lower portion of the housing so as to be swung upwardly. The safety lid is attached concentric to the hinge shaft of the knife hood.

This prior art bowl cutter apparatus has various disadvantages. The knife hood, which swings up and to the rear, presents an obstacle when cleaning or exchanging the blades for sharpening. There is no direct access to the knives from the rear, but rather only from side, which is inconvenient. With larger machines the service personnel must climb into the bowl to clean the knives. The danger of slipping in the wet bowl is great and has already caused various types of injuries. Further, the knife hood can only be opened when the safety lid has been previously swung up, and this presents another obstacle for the person cleaning the installation. The cast construction of the apparatus is also expensive and very heavy. Finally, the drive motors, the gears and the controls are housed in the same area, thereby making the transport and installation of larger machines more difficult.

German Pat. No. 2,425,142 suggests providing a hinge shaft, onto which the knife hood and the safety lid are attached, approximately in the middle above the bowl. Both coverings can be swung open in opposite directions independent of one another around this common shaft. The safety lid is made of plexiglass so that the food can be observed while being cut and mixed. Swinging the knife hood up removes it as an obstacle so that service operations can be carried out more rapidly and comfortably in comparison with the apparatus of DE-OS No. 2,155,647. The hinge shaft located diagonally above the bowl, however, is itself an obstacle and occupies an unnecessarily large empty space above the bowl. Its position and construction involving two concentric hollow shafts is also complicated. As a result of the small opening angle, the two hoods cannot be completely and simultaneously opened, and they are also difficult to seal shut for vacuum cutting.

SUMMARY OF THE INVENTION

The object of this invention is to produce a light weight bowl cutter apparatus which can be economically produced, is simple to transport and install, and whose service and maintenance procedures can be carried out without problems, comfortably, and without the danger of an accident.

This object is solved according to the invention in that below the bowl a primary plate is disposed on whose one side an upwardly extending side wall is attached. An angled yoke, extending approximately over the middle of the bowl, is attached at one end to the sidewall and at the other end to the opposite side of the primary plate.

The primary plate, the sidewall and the yoke form the bearing element of the cutter to which all of the important functional parts are attached. The self-contained construction provides an integral power transfer and high stability within the machine assembly.

The knife shaft is journaled in a horizontal support arm attached to the sidewall, and this arm is connected to the yoke and supported by a wall on the primary plate, thereby providing additional reinforcement for the support arm.

Both hoods are connected to the yoke by independent hinges arranged parallel and at a distance from one another on both sides of the yoke. By using two hinges it is possible to achieve a better sealing of the hoods, and the opening angle when both hoods are simultaneously opened is greater than with a common hinge.

DETAILED DESCRIPTION OF THE PREFERRED EMBODIMENTS

Figure 1:
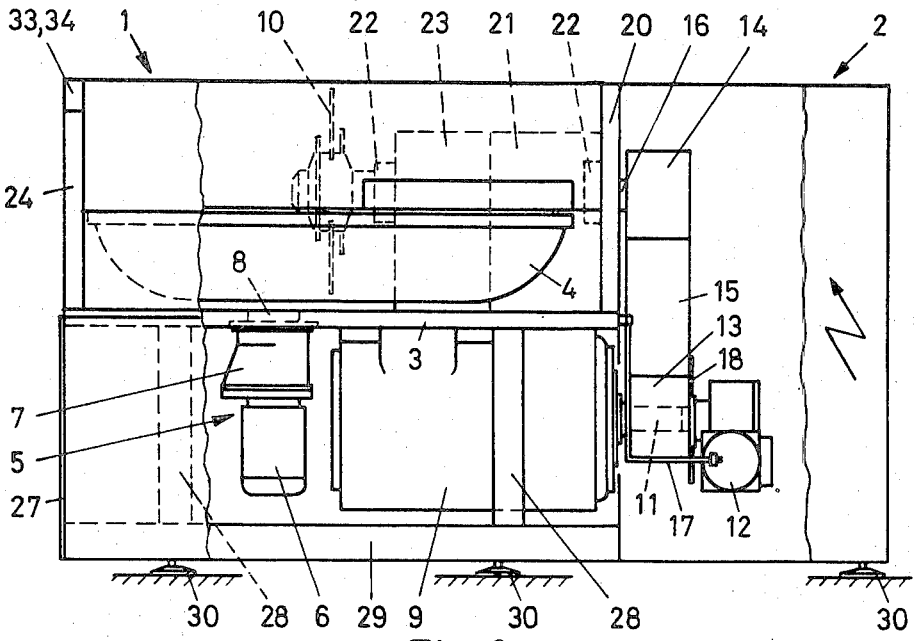
FIG. 1 shows a side view of a bowl cutter and mixer apparatus according to the invention with part of the machine case removed.
Figure 2:
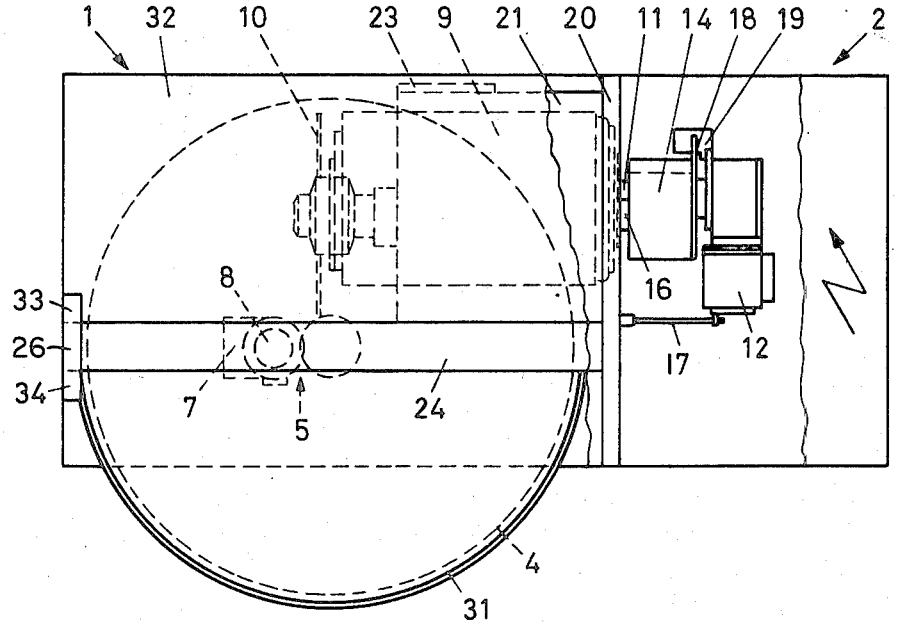
FIG. 2 shows a top view of the apparatus.
Figure 3:
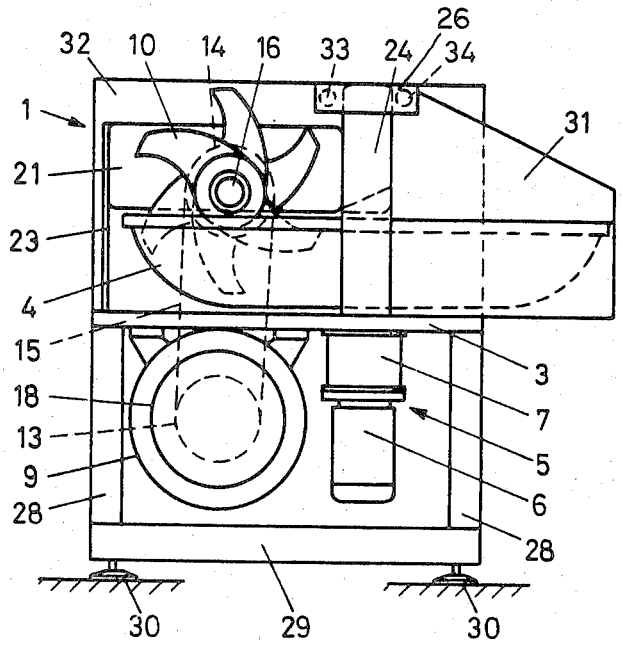
FIG. 3 shows a front view of the apparatus with the hoods closed.

The bowl cutter and mixer apparatus illustrated in the drawings consists of a machine assembly 1 and a light weight switch box 2 attached to it. This two-piece construction of the cutter makes the entire unit more economical and lighter in weight compared to conventional bowl cutters having a one-piece housing. Transportation and assembly are simplified and service work can be more easily performed.

The machine assembly includes a horizontal steel plate 3 in which a vertical drive shaft 8 for a bowl 4, disposed above the plate, is rotatably mounted. A bowl drive 5, consisting of an electric motor 6 and a reduction gear unit 7, is mounted below plate 3 so that the drive shaft 8 extends through the plate.

A motor 9 which drives the cutter knives 10 is also mounted below plate 3. Its horizontal motor shaft 11 extends partially into the switch box 2. The knife shaft 16 is driven by the motor 9 through two pulleys 13, 14 and a drive belt 15. The horizontal knife shaft 16 is disposed above the plate 3 and is perpendicular to the bowl axis. A small motor and worm gear unit 12 is provided for rotating the knife blades at a relatively slow mixing speed, and is supported by rod 17 depending from plate 3. It engages the end of the shaft of motor 9 through a free wheeling clutch, which is disengaged when the more powerful cutting speed motor 9 is in operation. A brake disk 18 is mounted on the bottom pulley 13 and is engaged by brake pads (not shown in detail) located in a saddle 19. A spur gear for controlling the mixing speed can be provided in place of the worm gear drive 12.

A vertical sidewall 20 is welded to plate 3 and supports an inwardly extending bearing arm 21 screwed into the sidewall and mounting inner and outer bearings 22 fo the knife shaft 16. The pulley 14 is mounted on the outer end of the knife shaft and extends into the switch box 2. The bearing arm is fixed to and held rigid by a vertical support wall 23 secured to the horizontal plate 3 proximate the inner bearing 22.

An angled yoke 24 reinforces the machine assembly and is disposed approximately in the middle above the bowl 4 and extends across it. One end of the yoke is screwed into the top of the sidewall 20, while the other end is attached to the steel plate 3. The yoke 24 is welded together from sheet metal so that it has a rectangular hollow profile when seen in cross-section. To reinforce and to dampen any vibration the interior cavity of the yoke 24 may be filled with concrete. It is also possible to foam fill the yoke with a artificial resin mass or with a concreted wood mass.

The steel plate 3, the sidewall 20 and the yoke 24 form the support for the machine assembly on which all important functional parts are mounted. The closed construction provides for an efficient power transfer, which in turn leads to a high level of machine stability.

The bearing arm 21, which is also attached to yoke 24, forms, together with the support wall 23, and additional reinforcement for the machine assembly. Finally, the outer machine shell 27 also adds reinforcement. An additional advantage of the yoke can be seen in the fact that it forms a straight-line covering reaching over the middle of the bowl 4 and thereby makes it difficult to reach into the knives when the safety hood 31 is open.

The steel plate 3 is connected by four angle iron columns 28 with the base frame 29, also made of angle irons. This in turn is supported by feet 30 on the floor. The removable switch box 2 is attached to the basic frame on the sidewall 20.

Figure 4:
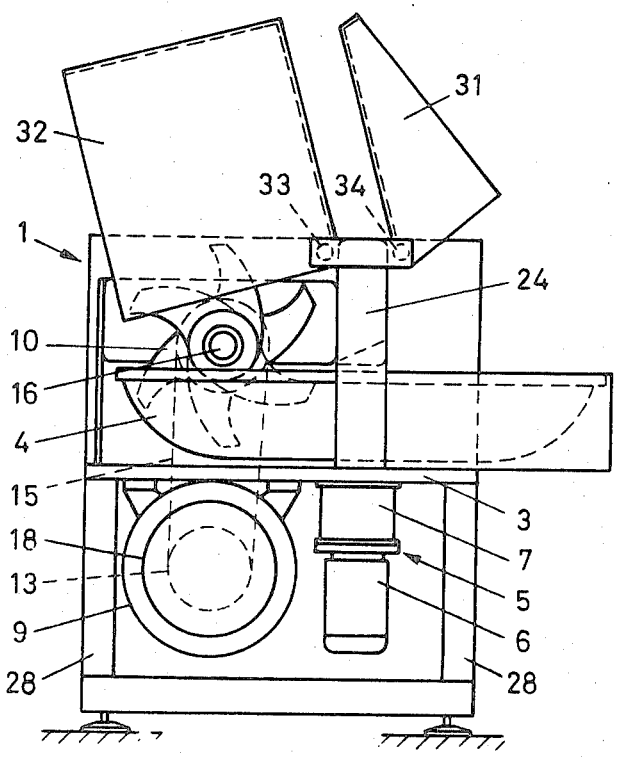
FIG. 4 shows a front view of the apparatus with the hoods opened.

The knife hood 32 and the front safety hood 31 are each attached by hinges 33, 34 to the yoke 24 so that they can be swung open and away from each other independently, as seen in FIG. 4. The two hinges 33, 34 are arranged on both sides of the yoke at a distance from one another and extend between a bearing bracket 26 and the sidewall 20, so that when both hoods are simultaneously opened the opening angle is relatively large.

The hoods are activated by hydraulic cylinders (not shown in detail), and may be tightly sealed when closed to produce a vacuum in the inner space so that the material being processed is not exposed to air during the processing.

What is claimed is:

1. An apparatus for cutting and mixing foodstuffs, comprising: a rotatable bowl (4) mounted in a housing, a plurality of rotatable knives (10) mounted on a knife shaft (16) and extending into the bowl, two separate hoods (31, 32) disposed to cover the housing, a pair of separate hinge means (33, 34) disposed centrally above the bowl and individually mounting the hoods such that they can be swung upwardly and apart independently of each other, a primary plate (3) disposed below the bowl, a vertical sidewall (20) attached to the plate and extending upwardly therefrom proximate one end thereof, and an angled yoke (24) extending above the bowl approximately across the middle thereof, said yoke being attached at one higher end to an upper portion of the sidewall and at the other, lower end to the opposite end of the primary plate, said plate, sidewall and yoke assembly constituting a rigid, closed structural core of said apparatus through which all forces act to thereby substantially eliminate operational vibrations, wherein the knife shaft is disposed transverse to the bowl axis (8) on a horizontal support arm (21), said arm being attached to the vertical sidewall and extending inwardly therefrom, connected to the yoke, and to a vertical wall (23) extending upwardly from the primary plate.

2. An apparatus according to claim 1, wherein the bowl is mounted in the primary plate, and drive means (6, 7, 9) for the bowl and the knives are mounted on the underside of the plate.

3. An apparatus according to claim 1, wherein one end of the knife shaft (16) extends through and to the outside of the sidewall, and supports a pulley (14) driven by a belt (15) coupled to an output shaft (11) of a horizontally mounted drive motor (9).

4. An apparatus according to claim 1, wherein the yoke is hollow, and is packed with a filler to give it rigidity and to serve as a vibration damper.

5. An apparatus according to claim 1, wherein both of the hoods are connected by hinges (33, 34) with the yoke, said hinges being arranged at a distance from one another on both sides of the yoke.

6. An apparatus according to claim 1, including a machine assembly (1) and a switch box (2) removably connected thereto.

7. An apparatus for cutting and mixing foodstuffs, comprising: a rotatable bowl (4) mounted in a housing, a plurality of rotatable knives (10) mounted on a knife shaft (16) and extending into the bowl, two separate hoods (31, 32) disposed to cover the housing, a pair of separate hinge means (33, 34) disposed centrally above the bowl and individually mounting the hoods such that they can be swung upwardly and apart independently of each other, a primary plate (3) disposed below the bowl, a vertical sidewall (20) attached to the plate and extending upwardly therefrom proximate one end thereof, and an angled yoke (24) extending above the bowl approximately across the middle thereof, said yoke being attached at one higher end to an upper portion of the sidewall and at the other, lower end to the opposite end of the primary plate, said plate, sidewall and yoke assembly constituting a rigid, closed structural core of said apparatus through which all forces act to thereby substantially eliminate operational vibrations, said knife shaft being disposed transverse to the bowl axis (8) on a horizontal support arm (21), said arm being attached to the sidewall and extending inwardly therefrom, connected to the yoke, and to a further vertical wall (23) extending upwardly from the primary plate, and wherein both of the hoods are connected by the hinge means to the yoke, said pair of hinge means being spaced from one another on opposite sides of the yoke.

8. An apparatus according to claim 7, wherein the bowl is mounted in the primary plate, and drive means (6, 7, 9) for the bowl and the knives are mounted on the underside of the plate.

9. An apparatus according to claim 7, wherein one end of the knife shaft (16) extends through and to the outside of the sidewall, and supports a pulley (14) driven by a belt (15) coupled to an output shaft (11) of a horizontally mounted drive motor (9).

10. An apparatus according to claim 7, wherein the yoke in hollow, and is packed with a filler to give it rigidity and to serve as a vibration damper.

11. An apparatus according to claim 7, including a machine assembly (1) and a switch box (2) removable connected thereto.

* * * * *